US005849094A

United States Patent [19]

Mignani

[11] Patent Number: 5,849,094

[45] Date of Patent: Dec. 15, 1998

[54] PROCESS FOR CLEANING METAL MACHINE PARTS CAKED WITH THERMOPLASTIC POLYMER

[75] Inventor: Mario Mignani, Casnigo, Italy

[73] Assignee: Movengineering S.r.l., Parre, Italy

[21] Appl. No.: 904,585

[22] Filed: Aug. 1, 1997

Related U.S. Application Data

[63] Continuation-in-part of Ser. No. 419,480, Apr. 10, 1995, abandoned.

[51] Int. Cl.[6] ..... B08B 3/10; B08B 5/00

[52] U.S. Cl. ..... 134/2; 134/5; 134/11; 134/19; 134/30; 134/25.1; 134/38

[58] Field of Search ..... 134/2, 5, 11, 19, 134/30, 25.1, 38

[56] References Cited

U.S. PATENT DOCUMENTS

| | | | |
|---|---|---|---|
| 2,917,418 | 12/1959 | Cathcart | 134/5 |
| 3,426,091 | 2/1969 | Miron et al. | 134/5 |
| 3,510,350 | 5/1970 | Priebe | 134/5 |
| 4,220,480 | 9/1980 | Dwan | 134/5 |
| 5,064,487 | 11/1991 | Fourné | 134/5 |

*Primary Examiner*—Zeinab El-Arini

*Attorney, Agent, or Firm*—Guido Modiano; Albert Josif

[57] ABSTRACT

Process for cleaning metal machine parts caked with thermoplastic polymers and apparatus for carrying out said process. The process consists in placing the parts caked with polymers inside an autoclave and in striking them with a stream of overheated steam. The stream mixes with the vaporized polymer residues produced by the thermal decomposition and hydrolysis of the polymers that are initially present on the parts and is conveyed outside the autoclave together with the vaporized residues. The stream containing vaporized polymer residues that leaves the autoclave is then subjected to condensation and the pollutants elimination.

12 Claims, 2 Drawing Sheets

PROCESS FOR CLEANING METAL MACHINE PARTS CAKED WITH THERMOPLASTIC POLYMER

CROSS REFERENCES TO RELATED APPLICATIONS

This is a continuation-in-part of the prior U.S. application Ser. No. 08/419,480, filed on Apr. 10, 1995, now abandoned.

BACKGROUND OF THE INVENTION

The present invention relates to a process for cleaning metal machine parts caked with thermoplastic polymers, such as for example polyamides, polyterephthalates, polyolefins, PVC, etcetera, and to an apparatus for carrying out said process.

Various processes are currently used to clean metal machine parts caked with thermoplastic polymers.

One of these processes consists in placing the parts to be cleaned inside special autoclaves in vacuum, where they are raised to a temperature that is substantially between 350° C. and 450° C. As a consequence of this temperature, the polymers melt, dripping from the metal parts. The polymer remained on the pieces tends to reticulate and form residual carbon products which stuck on the surface of the pieces and which are removable with great difficulty. For this reason this process is not suitable for cleaning pieces that, because of their shape, do not allow the polymer to drain. With this process, only part of the polymers undergoes thermal degradation, converting into gaseous substances which are aspirated by the vacuum system, whereas the remaining part collects on the bottom of the autoclave, producing a malodorous solid waste. Since the fumes are not oxidized, they too are highly polluting and normally require an oxidation process to purify them, such as reheating.

Another process currently used to clean machine parts caked with polymers consists in placing the parts to be processed in non-hermetic ovens, where a forced circulation of air is produced at a temperature that is substantially between 400° C. and 500° C. In a process of this kind, the polymers melt and burn, producing considerable amounts of fumes formed by malodorous partially oxidized substances and other exothermic reactions which are highly polluting due to the presence of cyanides and cyanates. Purification of these fumes is very difficult. This type of process furthermore produces micro-combustions that cause uncontrolled increases in temperature on the treated parts, leading to sometimes irreparable damage to the parts, such as for example deformations or changes in the crystalline state of the metal of which said parts are made, with a consequent alteration of their hardness and mechanical strength.

In another process, the parts to be cleaned are placed in baths of chemical solvents which are normally at a temperature that is substantially between 200° C. and 300° C. Such a process is very expensive due to the large consumption of solvents and produces a considerable amount of waste that is very difficult and expensive to dispose. Usually solvents are very effective on normal polymers but are very weak on gels (little parts of polymer with reticular structure) and on carbon aggregates which are potentially present in little quantity on the polymers.

Another process is also known in which the metal parts to be cleaned are immersed in baths of molten salts at a temperature of 400°–500° C. The polymers melt and degrade, lose viscosity, and become vapors that rise to the surface of the salts, catching fire and producing considerable amounts of malodorous and polluting fumes that are difficult to treat. This process is not in widespread use due to its intrinsic dangerousness.

Another process is also known that consists in immersing the parts to be cleaned in a bath of alumina oxide sand heated to 400°–500° C. and fluidified with a stream of hot air. The alumina sand moderates the oxidation and thermal degradation of the polymers. However, this process is not free from ecological problems, since it can release into the environment fumes and metal dust that is entrained outwards by the fluidification air. Furthermore, from a strictly mechanical point of view, this type of process is not adapted for cleaning parts having openings of the same size as the alumina granules, such as for example spinnerets for synthetic fibers that have contoured holes, since the alumina granules remain trapped in the openings of the parts and removal of the alumina from these openings is often very difficult. Furthermore, with this process it is not possible to clean filtration elements to be reused, such as for examples disks or cartridges made of sintered products or of multilayer meshes, since the alumina becomes a contaminant for the filtering element itself.

Another known process specific for PET corresponding to the patent U.S. Pat. No. 2,917,418, comprises two steps: the first step of contacting the pieces caked with polymer with a gas (air) at 275°–350° C., thereby a portion of the polymer is melted and removed in melted state, and a second step of contacting the pieces with a gas (air mixed with steam) at a growing temperature of 50° C./h from 325°–525° C. until the remaining polymer is vaporized, followed by a step of contacting the pieces with steam. Such a process may be successfully used for cleaning pieces having a suitable form so that the melted polymer may flow from the pieces to be collected. Moreover, the pieces must be disposed in the cleaning apparatus in a position which allows the melted polymer to flow from the piece and to be collected.

The disadvantages and the limits of this process are:

only a small part of the polymer is vaporized;

the presence of air in the fluxing gases of the cleaning apparatus when the components are still caked with polymer restricts the process to oxidation resistant polymers such as PET. In the first step, however, also PET, because of the presence of air, causes the forming of residual carbon products and can cause combustions which damage the components to be cleaned.

Another known process corresponding to U.S. Pat. No. 5,064,487 consists in subjecting the pieces caked with polymer to a first treatment for a structural cleavage of the polymer macromolecules so that the melted polymer drip easily from the pieces and can be easily collected and disposed as waste; lately, the pieces are subjected to under vacuum pyrolysis treatment.

The method to obtain the structural cleavage of the macromolecules can be: the hydrolysis (obtained with steam added to air and acid or alkaline chemical substances) and the glycolysis (obtained by contacting the polymer with glycols).

The disadvantages of the process are:

it is suitable only for pieces from which the polymer can drip;

the use of expensive and polluting chemical substances;

the use of vacuum tight autoclaves;

the pyrolysis on the pieces which are still dirty with polymer can cause the formation of residual carbon products and microcombustions which can damage the pieces.

SUMMARY OF THE INVENTION

A principal aim of the present invention is to solve the problems described above with reference to the processes currently used to clean metal machine parts caked with thermoplastic polymers by providing a process that allows to clean metal machine parts caked with polymers in a satisfactory manner and with low running costs, independently of the position of the parts to be cleaned in the cleaning apparatus, said parts being of every kind and shape, included the pieces which would not allow the melted polymer to flow from surfaces thereof and to be collected.

Another aim of the invention is that of proposing a process which during the cleaning cycle eliminates the risk of reticulation phenomena in the polymers and the forming of residual carbon products.

Another aim of the invention is to provide a process which leads to a progressive breakage of the molecular chains until substantially all the polymer is transformed in compounds which, at the process temperature, are at vapor state thereby no melted polymer flows from the parts; and in which the phenomenon of progressive breakage of the molecular chains happens in all the polymer stuck to the parts to be cleaned, so not to leave solid polymer residues to dispose.

Within the scope of this aim, an object of the invention is to provide a process that produces limited amounts of pollutants and does not produce special solid waste that requires particular treatments for its disposal.

Another object of the invention is to provide a process that ensures the elimination of the pollutants of the degradation of the polymers.

Another aim of the invention is to provide a process which obtains the degradation of the polymer with an endothermic reaction and which eliminates every risk of microcombustions and offers adequate guarantees against damages of the pieces during the cleaning treatment.

Another object of the invention is to provide a process that can be used without problems in cleaning mechanical parts that have holes, such as for example in the case of spinnerets used to produce fibers, and is also adapted to clean assembled spinneret packs containing metallic or quartz sand as a filtering agent and assembled filter housings containing filtering elements or candles.

Another aim of the invention is to provide a process which attains the aim of perfect cleaning also by operating at ambient pressure, so that it does not require a vacuum or under pressure cleaning chamber.

Another aim of the invention is to provide a process which is effective not only in the removal of the normal polymers, but also of gels and carbon compounds if contained in the polymers and remained in the filter elements.

Another aim of the invention is to provide a process which can be carried out at the maximum temperature adequate to the metal of the parts to be cleaned.

Another object of the invention is to provide an apparatus for carrying out the complete process according to the invention without intermediate manipulations of the pieces.

This aim, these objects, and others which will become apparent hereinafter are achieved by a process for cleaning metal machine parts caked with thermoplastic polymers, comprising the following steps:

1-placing the parts caked with polymer inside the autoclave heated at a temperature of 380°–450° C. and closing the autoclave;

2-fluxing the autoclave with a stream of overheated steam to quickly eliminate every trace of air from the autoclave, thereby an environment void of oxygen is obtained in the autoclave;

3-feeding in said autoclave a stream of superheated steam at a temperature of 400°–500° C. to simultaneously subject the polymer to hydrolysis and pyrolysis in the absence of oxygen, thereby any oxidation and combustion and formation of residual carbon products are prevented and all the polymer is vaporized without leaving any residue on the pieces or in the autoclave, no melted polymer or liquid residues being formed, the temperature of the superheated steam being with 20°–50° C. higher than the temperature of the autoclave walls, the pressure inside the autoclave being between 0.7 and 1.2 at, said vaporized polymer components leaving the autoclave in a stream containing said vaporized polymer components and overheated steam, said feeding being continued until all the polymer degradable by hydrolysis is degraded.

The process according to the invention is preferably performed with an apparatus characterized in that it comprises an autoclave containing the parts to be treated and in which the inside is connected to a fluid supply duct and to a duct for discharging said fluid, said supply duct being connected to means for heating said fluid and being controllably connectable to a steam supply line and to an air supply line; means being furthermore provided on said discharge duct for treating the fluid that leaves said autoclave in order to eliminate the pollutants that are present in said fluid.

BRIEF DESCRIPTION OF THE DRAWINGS

Further characteristics and advantages of the invention will become apparent from the following detailed description of a preferred but not exclusive embodiment of the process according to the invention and of an apparatus for carrying out said process, illustrated only by way of non-limitative example in the accompanying drawings, wherein.

DESCRIPTION OF THE PREFERRED EMBODIMENTS

Figure 1:
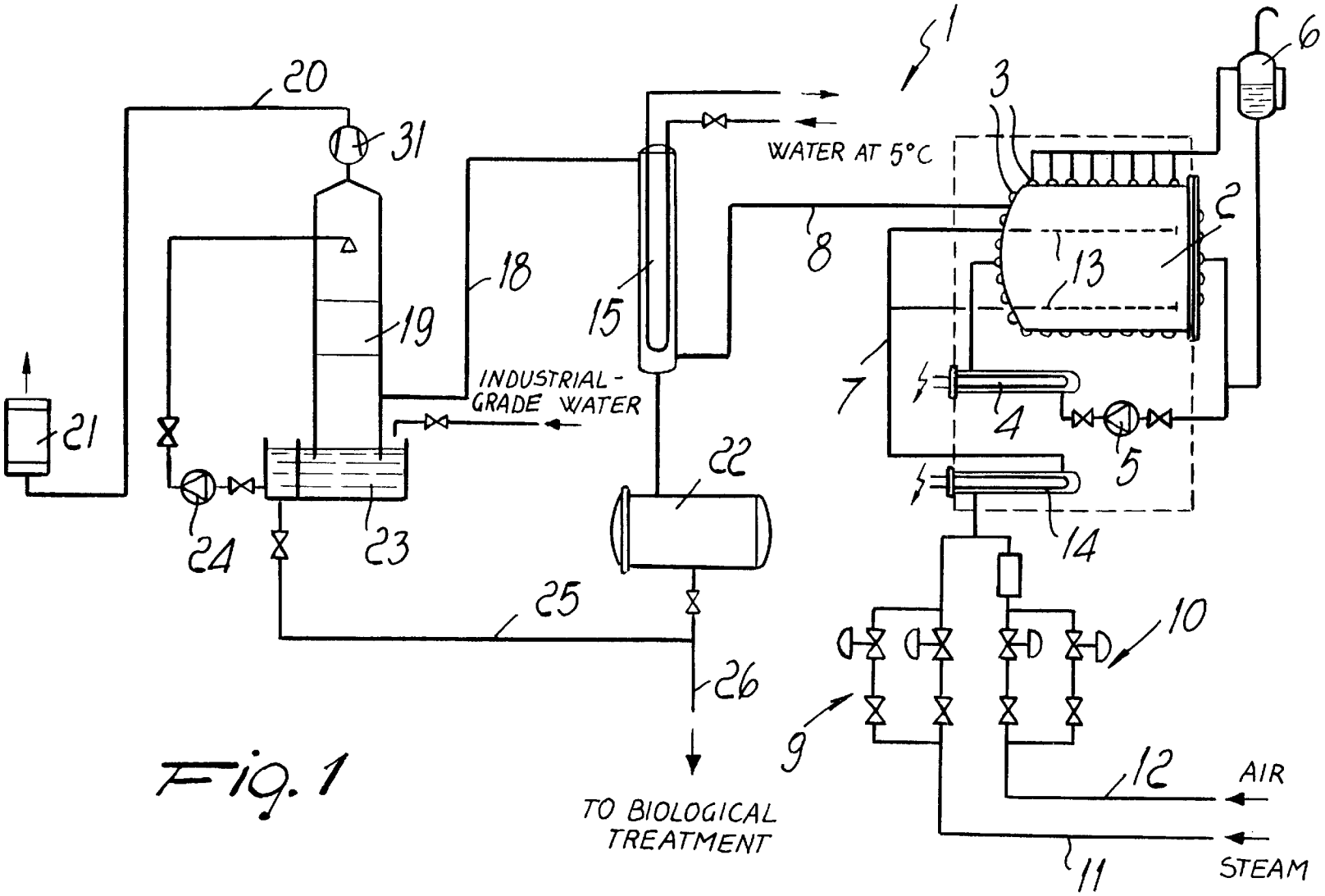
FIG. 1 is a schematic view of an apparatus for carrying out the process according to the invention.

With reference to the above figures, the apparatus for carrying out the process according to the invention, generally designated by the reference numeral 1, comprises an autoclave 2, 2*a* for containing the polymer-caked parts to be cleaned.

As shown in particular in FIG. 1, the autoclave 2 can be heated by means of a jacket formed by half-tubes 3 applied to its outer surface and supplied, in a closed circuit with a diathermic fluid of a known type which is heated by means of a heater 4, for example of the electric type. The autoclave heating system also includes a pump 5 for circulating the diathermic fluid and an expansion tank 6.

Figure 2:
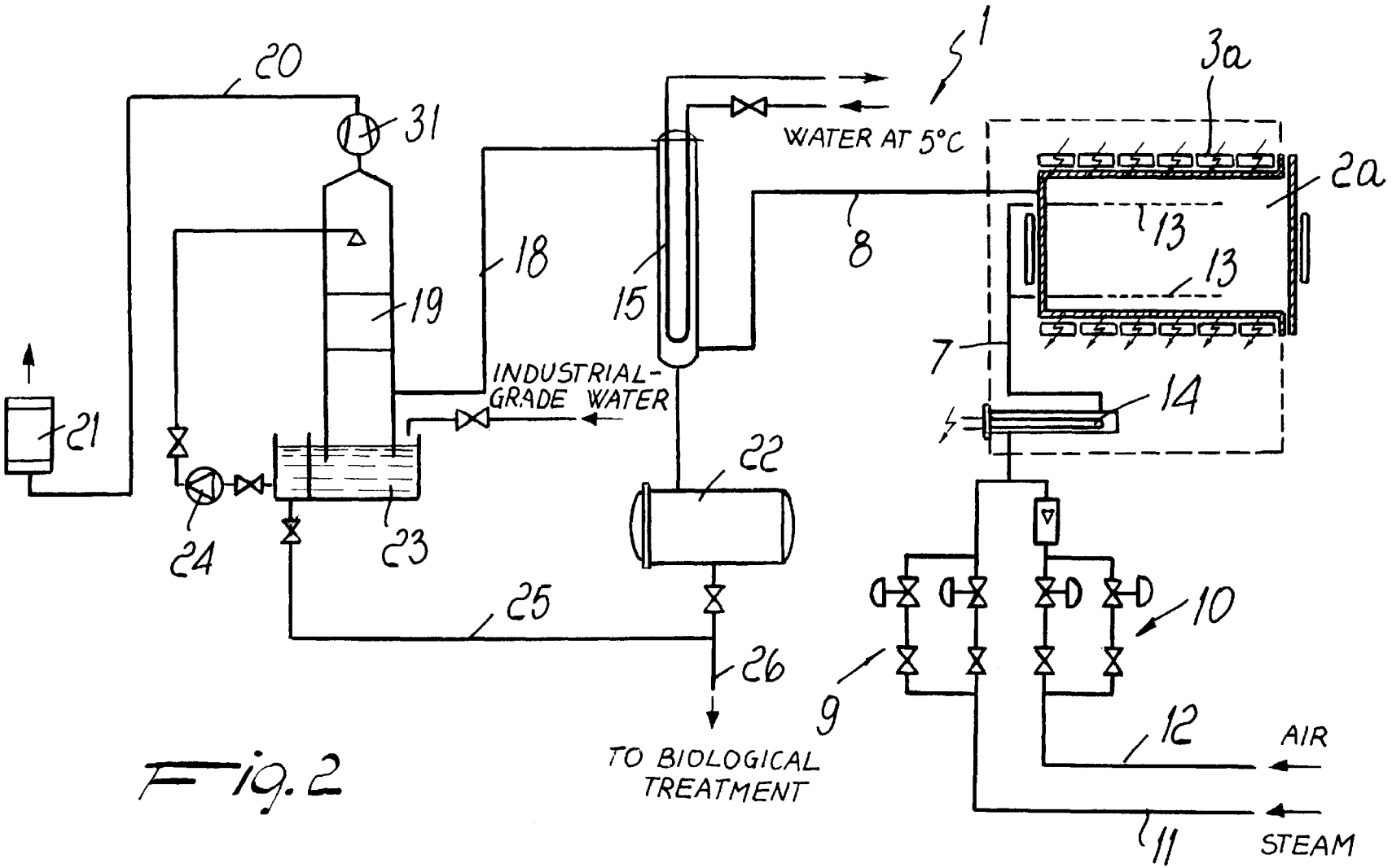
FIG. 2 is a view of a different embodiment of the autoclave in the apparatus for carrying out the process according to the invention.

As shown in particular in FIG. 2, the autoclave 2*a* can also be heated by means of electric resistors 3*a* applied to its outer surface.

The inside of the autoclave 2 is connected to a supply duct 7 and to a discharge duct 8; the supply duct 7 can be connected, by virtue of control means constituted for example by electric valves 9 and 10, to a steam supply line 11 and to an air supply line 12.

The supply duct 7 supplies one or more diffusers 13, for example conventional perforated diffusers, which are arranged inside the autoclave 2, 2*a* and produce a uniform distribution of the fluid, which is supplied through the supply duct 7, inside the autoclave 2, 2*a*.

A heater 14, preferably of the electric type, is furthermore arranged along the supply duct 7 in order to superheat the fluid supplied to the autoclave by means of the supply duct 7.

The discharge duct 8 is connected to a heat exchanger-condenser 15 which is supplied with water preferably at a temperature that is substantially between 3° C. and 30° C. The discharge duct of the heat exchanger-condenser 15 is connected to the inlet 18 of a conventional fume scrubbing tower 19.

An aspirator device 31 is placed on the output duct 20 of the scrubbing tower 19, and proximate to the outlet of said duct 20 there is an activated-charcoal filter 21 or the inlet of a unit for treating the fumes by means of conventional catalysts.

The bottom of the heat exchanger-condenser 15 is connected to a tank 22 in which the condensate produced by the cooling performed in the heat exchanger 15 is collected.

The scrubbing tower 19 has a collecting tank 23 for the scrubbing liquid, which can be optionally recirculated by means of a pump 24; the discharge of said tank 23 is connected, through a duct 25, to the discharge 26 of the tank 22.

The operation of the apparatus, in a preferred but not exclusive embodiment of the process according to the invention, is as follows.

The polymer-caked parts are placed, for example in baskets, and closed inside the autoclave 2, 2*a*, which is heated by means of the diathermic fluid or by means of the electric resistors up to an adjustable temperature that is preferably between 380° C. and 450° C.

The autoclave is then fluxed, soon after closing, with a stream of overheated steam to quickly eliminate every trace of air from the autoclave, in order to obtain inside the autoclave an environment free of oxygen.

The autoclave 2, 2*a* is fed with a stream of superheated steam, preferably at a temperature substantially between 400° C. and 500° C. The steam is introduced through the supply duct 7 after preliminary heating performed by the heater 14. The fluid thus superheated is diffused inside the autoclave 30 2, 2*a*, thereby the temperature inside the autoclave is substantially between 380° C. and 450° C.

This produces inside the autoclave 2, 2*a* a temperature that is sufficient to cause the degradation by simultaneous and combined pyrolysis and hydrolysis of the polymer without any oxidation and microcombustion risks since the environment is saturated with superheated steam and does not contain oxygen. The formation of carbonious residues is also prevented. The treatment, of pyrolysis and hydrolysis of the polymer, with superheated steam at such a temperature results in the progressive breakage of the polymeric molecular chains until substances are formed with such a low molecular weight that they turn to vapor state at the temperature existing in the autoclave.

The superheated steam temperature is regulated at a value which is 20°–50° C. higher than the autoclave wall temperature in order to avoid that during the phase of progressive breakage of the polymer molecular chains the temperature decreases—because of the endothermic effect of the hydrolysis reaction—reaching a lower temperature than the autoclave walls temperature. The feeding with superheated steam is continued until all the polymer contained on the parts to be cleaned is transformed in low molecular weight compounds which are vaporized at the working temperature (pyrolysis) combined with the action of the superheated steam (hydrolysis).

The degradation of the polymer exclusively in the presence of superheated steam avoids phenomena of polymeric chain reticulation and formation of residual carbon products stuck on the parts.

A stream of overheated steam containing the vaporized compound is removed through the discharge duct 8.

In one embodiment of the process of the present invention, once the degradation step has ended, a mixture of superheated steam at a temperature substantially between 400° C. and 500° C. and of air heated to the same temperature is introduced in the autoclave 2, 2*a*. The mixture of air and steam is introduced through the supply duct 7 after preliminary heating performed by the heater 14. The fluid thus superheated is diffused inside the autoclave 2, 2*a*, thereby the temperature inside the autoclave is substantially between 380° C. and 450° C.

During this step the pyrolysis and hydrolysis action is integrated with an oxidation action to speed up the degradation of the components resistant to hydrolysis. The presence of vapour and the hydrolysis reaction balances and absorbs the heat generated by the oxidation, thereby stopping every micro-combustion phenomenon.

A mixture of superheated steam, air, and vaporized residues of decomposed polymers forms inside the autoclave 2, 2*a* and is removed through the discharge duct 8.

Preferably, the control unit 9 then discontinues the supply of steam, so that only air heated to a temperature between 380° C. and 450° C., preferably about 420° C., is fed into the autoclave, so as to maintain a temperature between 420° C. and 450° C. inside the autoclave. The introduction of this air in the autoclave causes the oxidation of the thin layer of soot some polymers leave on the parts to be cleaned.

In another embodiment of the present invention, the above treatment with air at 380°–450° C. is carried out after the hydrolysis degradation step. In a further embodiment of the present invention, such a treatment is carried out both after the hydrolysis degradation step and the combined pyrolysis and oxidation step.

In practice, in the process of the present invention, in the autoclave 2, 2*a* the polymers are melted rapidly by the action of the superheated steam at high temperature and are attacked by a synergistically combined action of thermal degradation (pyrolysis) and hydrolysis which fully converts them into substances which are in vapor state at the process temperature and leave the autoclave together with the steam, no solid or liquid residues being formed inside the autoclave.

The stream of fluid containing vaporized residues of thermally decomposed polymers that leaves the autoclave through the duct 8 is subjected to a treatment so as to eliminate the decomposed polymer residues. This treatment includes the cooling of the fluid in the heat exchanger 15, supplied with water at approximately 5° C. This cooling condenses the contained vapors and the condensate is sent to the tank 22 and is meant to undergo a subsequent biological treatment.

The fumes that leave the heat exchanger 15 are scrubbed in the tower 19 and subsequently filtered with the activated-charcoal filter; at this point they are purified and are discharged into the atmosphere. The fume scrubbing water from the tower 19 is also meant to undergo a biological treatment.

The process is normally performed at ambient pressure; however, according to the requirements, its pressure may vary between 0.7 and 1.3 ata (absolute pressure).

In practice it has been observed that the process according to the invention fully achieves the intended aim, since it achieves an optimum cleaning of the treated parts without damaging them and without using solvents or other chemical substances; accordingly, it allows to reduce plant and running costs with respect to conventional processes that use such substances.

Another advantage resides in the fact that the polymers decomposed by the process according to the invention leave the autoclave in the form of gas or vapors, thus assuredly eliminating the possibility of solid wastes remaining in the autoclave at the end of the treatment.

The process and the apparatus for carrying out said process, as conceived, are susceptible of numerous modifications and variations, all of which are within the scope of the same inventive concept; all the details may furthermore be replaced with other technically equivalent elements.

In practice, the materials employed, as well as the dimensions, may be any according to the requirements and the state of the art.

What is claimed is:

1. Process for cleaning metal machine parts caked with thermoplastic polymers, comprising the following steps:

1A-placing the parts caked with polymer inside an autoclave heated at a temperature of 380°–450° C. and closing the autoclave;

1B-fluxing the autoclave with a stream of overheated steam to quickly eliminate every trace of air from the autoclave, thereby an environment void of oxygen is obtained in the autoclave;

1C-feeding in said autoclave a stream of superheated steam at a temperature of 400°–500° C. to simultaneously subject the polymer to hydrolysis and pyrolysis in the absence of oxygen, thereby oxidation, molecular chain reticulation phenomena and formation of carbonious residues are prevented and all the polymer is vaporized, thereby vaporized polymer residues are formed without leaving any solid or liquid waste in the autoclave, the temperature of the superheated steam being about 20°–50° C. higher than the temperature of the autoclave walls, in order to avoid decrease of the temperature inside the autoclave below the temperature of the autoclave walls during the progressive breakage of the polymer molecular chains, because of an endothermic effect of the hydrolysis reaction, said vaporized polymer residues leaving the autoclave in a stream containing said vaporized polymer residues and superheated steam, said feeding being continued until all the polymer degradable by hydrolysis is degraded.

2. Process according to claim 1, further comprising after step 1C the step of:

2-feeding in said autoclave a mixture of superheated steam and air at a temperature of 400°–500° C., thereby simultaneously subjecting the polymer to pyrolysis, hydrolysis and oxidation in order to speed up the degradation and vaporization of pigments and additives present in the polymer which are non-hydrolyzable and to form vaporized substances, said vaporized substances leaving the autoclave with a mixture of air and superheated steam.

3. Process according to claim 2, further comprising after step 2 the step of feeding in said autoclave a stream of air at 380°–450° C. to oxidize a thin layer of soot left on the parts after step 2.

4. Process according to claim 1, further comprising after step 1C the step of feeding in said autoclave a stream of air at 380°–450° C. to oxidize a thin layer of soot left on the parts after step 1C.

5. Process according to claim 4 wherein the stream comprising vaporized polymer residues which leaves the autoclave, is cooled to condense vapors contained in the stream, thereby a condensate and non-condensable fumes being obtained.

6. Process according to claim 5, wherein the condensate is further subjected to a biologic treatment.

7. Process according to claim 5, wherein the fumes are further subjected to scrubbing.

8. Process according to claim 5, wherein after said scrubbing the fumes are filtered on an activated carbon filter.

9. Process according to claim 4 wherein the stream comprising vaporized polymer residues which leaves the autoclave, is cooled to condense vapors contained therein, thereby a condensate and fumes containing incondensable components being obtained.

10. Process according to claim 9, wherein the condensate is further subjected to a biological treatment.

11. Process according to claim 9, wherein the fumes are further subjected to scrubbing.

12. Process according to claim 11, wherein after said scrubbing the fumes are filtered on an activated filter.

* * * * *